US005301981A

United States Patent [19]

Nesis

[11] Patent Number: 5,301,981

[45] Date of Patent: Apr. 12, 1994

[54] COPY PREVENTING DEVICE AND METHOD

[75] Inventor: Dov Nesis, New York, N.Y.

[73] Assignee: Docusafe, Ltd., Road Town, V.I.

[21] Appl. No.: 968,249

[22] Filed: Oct. 29, 1992

Related U.S. Application Data

[63] Continuation-in-part of Ser. No. 912,093, Jul. 9, 1992, abandoned.

[51] Int. Cl.[5] ..... B42D 15/00

[52] U.S. Cl. ..... 283/73; 283/17; 283/902; 380/54

[58] Field of Search ..... 283/72, 17, 73, 94, 283/901, 902; 229/68 R, 305, 306; 380/54, 55

[56] References Cited

U.S. PATENT DOCUMENTS

| | | | |
|---|---|---|---|
| 3,151,520 | 10/1964 | Nadean | 380/54 X |
| 3,178,993 | 4/1965 | Ferris et al. | 283/73 X |
| 4,498,736 | 2/1985 | Griffin | 380/54 |
| 4,557,505 | 12/1985 | Schaefer et al. | 283/94 X |
| 4,912,761 | 3/1990 | Tan et al. | 380/54 X |
| 5,071,061 | 12/1991 | Willis | 229/303 |
| 5,197,663 | 3/1993 | Stude | 229/303 |

*Primary Examiner*—Timothy V. Eley
*Assistant Examiner*—Willmon Fridie, Jr.
*Attorney, Agent, or Firm*—Robert W. J. Usher

[57] ABSTRACT

A copy preventing sheet-form screen comprises a lenticular screen formed by a sheet of transparent plastic material having, a series of adjacent lens portions with major optical axes perpendicular to the front face and a series of light blocking striae located spaced apart underlying respective lens portions. The striae extend across a major part of the major optical axes so that when covering a sheet printed with meaningful information, the screen enables the information to be easily seen when viewed obliquely in ambient white light but prevents a meaningful copy thereof being made by conventional, perpendicularly aligned, phototransference techniques. The screen can be attached to the printed sheet by adhesive or formed as an adhesive tape to cover only preselected areas of printing. The screen may also form one or both sides of a security envelope enclosing the printed sheet and sealed by a security label carrying an authorized signature.

16 Claims, 2 Drawing Sheets

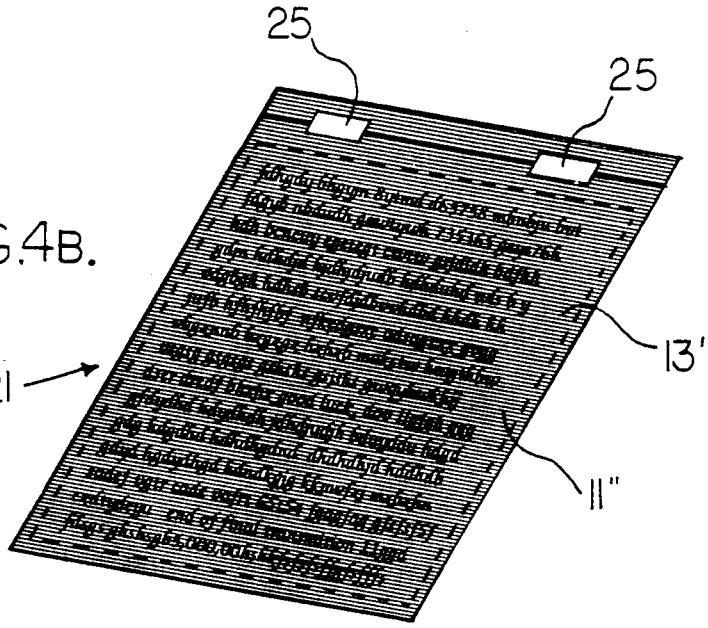
FIG.4B.
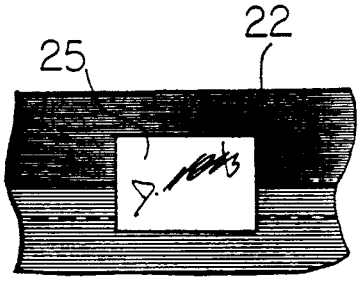
FIG.4C.
FIG.5.
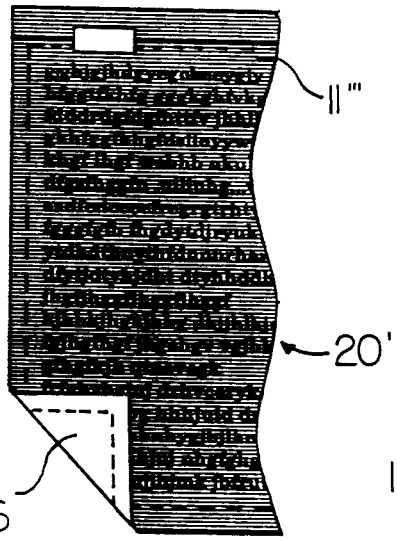
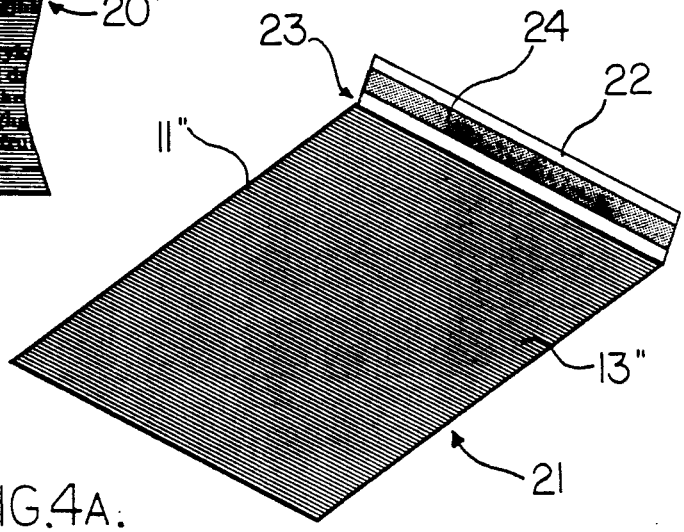
FIG.4A.

COPY PREVENTING DEVICE AND METHOD

This is a continuation in part application of Ser. No. 07/912,093, filed Jul. 9, 1992, now abandoned.

FIELD OF THE INVENTION

The invention relates to a method and device for preventing meaningful copies of sheets of information being made by the usual perpendicularly aligned, phototransference techniques such as xerographic, offset printing, and facsimile processes.

BACKGROUND OF THE INVENTION

The importance of preventing unauthorized copying by such phototransference techniques confidential and other meaningful information such as customer lists, formulae, plans, designs and signatures is well recognized.

Previous attempts at copy prevention have not proven entirely satisfactory. Such approaches have, for example, included printing the information on paper colored to provide insufficient contrast with the printed material when photocopied by xerographic or electrostatic copying techniques but legible to the naked eye in ambient white light. However, such approaches require specially dedicated paper and printing techniques as limitations are imposed on the colors of print and paper and the contrast is usually considered to be rather poor so as to render the document somewhat difficult to read, particularly at a distance, unattractive to both read and handle and generally aesthetically undesirable.

Another approach has been to print the information in a color, such as yellow, to which the standard copier is relatively insensitive.

Examples of such prior approaches are taught by U.S. Pat. No. 4,632,429 issued Dec. 30, 1986 to Gardner; U.S. Pat. No. 4,522,429 issued Jun. 11, 1985 to Gardner and U.S. Pat. No. 4,281,931 issued Aug. 4, 1981 to Van Auken.

It is known to provide displays in which two or more pictures or words can be seen by varying the viewing angle, often to provide a motion or a three dimensional effect, by splitting representations of the different pictures or words into striae, arranged alternately in association with optical screen structures which provide preferential reflection of the respective striae at the differing angles of incident light. However, none of these proposals teach the present invention.

Examples of optical screen structures used for this purpose, including some which incorporate lenticular screens, are taught in U.S. Pat. No. 3,119,195 issued Jan. 28, 1964 to Broaunhut ; U.S. Pat. No. 3,586,592 issued Jun. 22, 1971 to Cahn; U.S. Pat. No. 1,475,430 issued Nov. 27, 1923 to Curwen; U.S. Pat. No. 3,268,238 issued Aug. 23, 1966 to Finkel; U.S. Pat. No. 2,832,593 issued Sep. 25, 1957 to Anderson and U.S. Pat. No. 1,969,551 issued Aug. 7, 1934 to Francis, the disclosures of which are incorporated by reference herein.

SUMMARY OF THE INVENTION

It is an object of the invention to provide a copy preventing device and method which will avoid or ameliorate at least some of the above mentioned disadvantages.

According to one aspect of the invention, a copy preventing sheet-form screen comprising a lenticular screen formed by a sheet of transparent material having front and rear faces and a series of adjacent lens portions with major optical axes perpendicular to the front face and a series of light blocking striae located spaced apart underlying respective lens portions and extending across a major part of their major optical axes so that positioning the copy preventing sheet-form screen with the rear face in covering relation to a sheet carrying indicia providing meaningful information, enables the information to be easily seen when viewed obliquely in ambient white light but prevents a meaningful copy thereof being made by conventional, perpendicularly aligned, phototransference techniques such as xerographic, offset printing, and facsimile processes.

Thus, the meaningful information may be read when the document is viewed obliquely but will be unintelligible when copied by the conventional, perpendicularly aligned, phototransference techniques such as xerographic, offset printing, and facsimile commonly available in offices.

The striae may be formed as dark bands or as mirror surfaces and may be applied to the rear face of the screen by a printing embossing or other suitable technique. The striae may also be formed within the screen material during manufacture thereof.

In a convenient form, the copy preventing sheet-form screen has a coating of contact adhesive on a rear face thereof covered by a removable backing sheet which may be simply peeled away to expose the adhesive permitting the copy preventing sheet-form screen simply positioned over and adhered to the document carrying information to be protected.

Alternatively, the information to be protected may be formed on the screen itself as striae alternating with the information obscuring striae, or, laminated on the rear face of the screen.

In a most convenient form the copy preventing sheet-form screen may be formed as adhesive tape enabling only precisely determined areas to be copy protected.

Where the lens portions are formed as segments of optical cylinders, a magnifying effect provided by the lens will also enhance readability of certain parts of the document by the naked eye providing some compensation for any loss of resolution or for any distortion caused by the presence of the screen. The focal length of each lenticle is equal to the lenticular screen thickness.

According to another aspect of the invention, a copy protected sheet comprises an optical screen including an array of adjacent, alternately arranged, first and second optical portions having respective major reflecting optical axis extending obliquely of and perpendicularly to the sheet, respectively, and an array of adjacent, alternately arranged, first and second striae of indicia forming meaningful information to be protected and other matter not to be protected, respectively, optically aligned with the first and second optical portions respectively, so that the information is easily seen when viewed obliquely in ambient white light but a legible copy of the meaningful information cannot be made by conventional, perpendicularly aligned, phototransference techniques such as xerographic, offset printing, and facsimile .

During the copying process, the image of the other matter only is received and recorded, the meaningful information is, in effect, masked as only a very minor or no copying light is incident thereon, producing a substantially black, grey or absence of image according to the nature of the other matter.

The optical portions may be formed by lens portions or reflective (mirrored/ silvered surfaces).

The invention obviates the practical disadvantages of needing to obtain special papers and inks, which are often relatively expensive, and enables use of conventional office printing methods and machines to print the protected information in house thereby also obviating a requirement for additional staff training.

According to a further aspect of the invention, there is provided a security envelope having opposite sides and a sheet receiving opening at one end, and means for sealing the security envelope in closed condition, at least one of said sides comprising an optically focused lenticular screen formed by a sheet of transparent material having front and rear faces and a series of adjacent lens portions with major optical axes perpendicular to the front face and a series of light blocking striae located spaced apart underlying respective lens portions and extending across a major part of their major optical axes to that a sheet marked with indicia providing meaningful information inserted in the envelope with the indicia towards the rear face, enables the information to be easily seen when viewed obliquely, after slight rotation from the major optical axes, in ambient white light but prevents a meaningful copy thereof being made of conventional, perpendicularly aligned, phototransference techniques including at least one of xerographic, offset printing, and facsimile.

Although the precise materials and dimensions may be substantially varied and it is normally preferred that the indicia are in sharp focus when viewed through the screen, a slight magnifying or reducing effect may be acceptable so far as the indicia remain legible.

BRIEF INTRODUCTION TO THE DRAWINGS

Specific embodiments of the invention will now be described by way of example only and with reference to the accompanying drawings in which:

FIG. 3(*b*) is a plan view representing a xerographic copy of the front of the screen protected sheet shown in FIG. 3(*a*); and, FIG. 3(*c*) is a fragmentary cross-sectional view of a first embodiment of the invention adhered to an information carrying sheet and illustrating the optical principles.

FIG. 4(*a*) is a perspective view of a third embodiment of the invention comprising a security envelope incorporating an optically focussed lenticular screen, in open condition;

FIG. 4(*b*) is a plan view of the security envelope shown in FIG. 4(*a*) in closed and sealed condition and containing a printed sheet to be copy protected;

FIG. 4(*c*) is a fragmentary view of a sealed area of the security envelope shown in FIG. 4(*b*); and FIG. 5 is a fragmentary view of an alternative embodiment of security envelope.

DESCRIPTION OF PARTICULAR EMBODIMENTS

Figure 1:
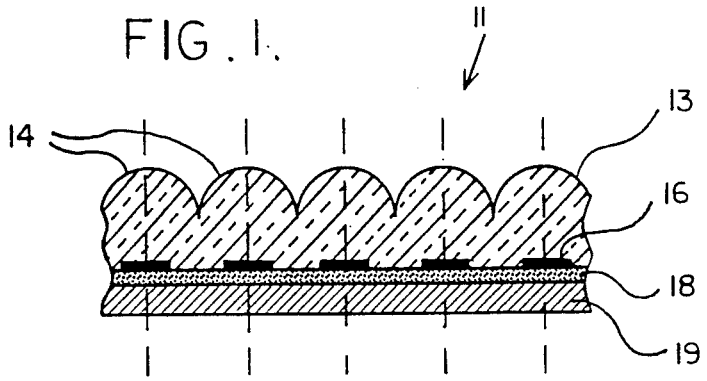
FIG. 1 is a fragmentary cross-sectional view of a first embodiment of the invention.

A protective sheet-form screen 11 comprises a lenticular screen formed by a sheet of suitable transparent plastic material such as PVC having a series of parallel ribs 14 of convex cross section forming segments of optical cylinders constituting respective hemi-cylindrical lens elements on a front face 13 thereof, with major optical axes of the respective lens elements substantially perpendicular to the sheet-form screen. Black bands 16 (eg ink.) are printed on the rear surface of the sheet-form screen in spaced apart relation underlying respective lens portions or elements and extending along and across their optical axes for approximately 50% of the width of the respective ribs. In this example, the ribs forming the individual lens elements are at a density of approximately 20 per cm. and the thickness of the screen is approximately 0.50 mm so that the screen is flexible. The radius of each cylindrical lens segment is approximately 0.25 mm, while the separation of each opaque band is approximately equal to the band width of approximately 0.25 mm.

A layer of contact adhesive 18, covered by a removable backing sheet-form screen 19, coats the rear face.

In use, the backing sheet is peeled away and a protective sheet-form screen adhered in covering relation to printed or other clearly copyable material to be protected from unauthorized copying by conventional, perpendicularly aligned, phototransference techniques such as xerographic, offset printing, and facsimile. During the copying process, the exposing light from the copier is incident perpendicularly, along the major optical axes, with the effect of spreading the opaque band, as shown at A in FIG. 3(*c*), so that the copied image completely masks the meaningful information.

Figure 3A:
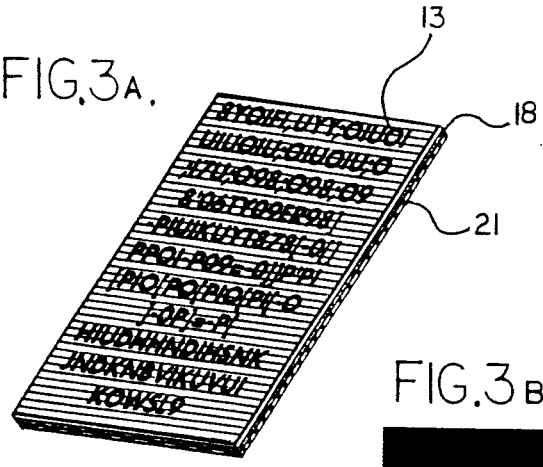
FIG. 3(*a*) is a perspective view of the screen adhered to an information carrying sheet.
Figure 3B:
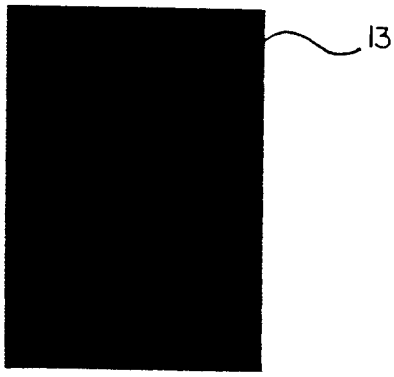
Figure 3C:
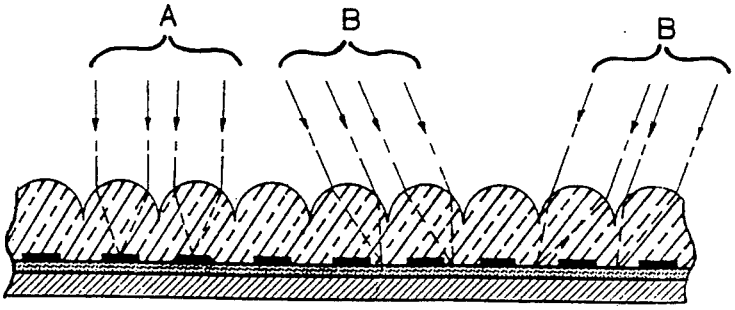

However, the information may be viewed by holding a sheet somewhat obliquely, as shown at B in FIG. 3(*c*) when the same spreading effect will not be obtained in respect of the opaque bands and the information located exposed in the spaces between the individual bands may be readily seen as a substantially continuous image.

Figure 2:
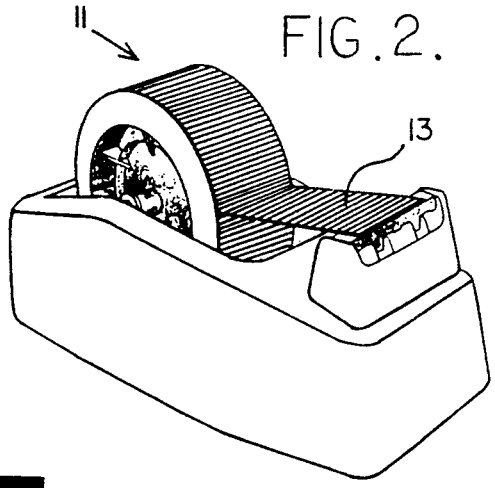
FIG. 2 is an adhesive tape according to a second embodiment of the invention.

In a second embodiment shown in FIG. 2, the protective sheet-form screen is formed as an adhesive tape 11' which provides a quick and convenient means for protecting only preselected areas of printed articles etc. while enabling a legible copy of the meaningful information on the remaining areas to be made.

In another embodiment shown in FIGS. 4(*a*)–4(*c*), a lenticular screen 11$^{II}$ forms both front and rear sides of a security envelope 20, the front or lenticular face of the screen being outermost. The front and rear sides are heat-sealed or otherwise fastened together, where necessary at the periphery, defining a top opening 23 for receiving a printed sheet 21, sealable in closed condition by a flap 22 coated with a permanent impact adhesive 24.

After insertion of the printed sheet, and folding and sealing the flap is closed condition, security oversealing labels 25 are applied across the junction of the flap with the front side as shown in FIG. 4(*b*) and signed by an authorized person.

As with the above described embodiments, attempts to copy the enclosed document by conventional, prependicularly aligned, phototransference techniques will merely result in a completely black copy whilst the document is clearly legible to the naked eye particularly when viewed slightly obliquely after tilting about the major parallel axies of the lenses.

Many criteria must be considered when designing an optimal copy preventing lenticular screen including thickness, cost, line (band) density, acceptable angle of individual lens segments (angle subtended by arcuate lens face) but the following approximate dimensions and materials are suitable for preventing copying by a CANON NP 4835i. The screen comprises a polypropylene lenticular layer laminated or otherwise intimately attached on a stiffening polyester base forming an integral sheet with a total thickness of 0.2 mm, line density of 87 lines per cm. lens radius of 0.07 mm, acceptance angle of 50°, lenticle width of 0.12 mm, line width of 0.06 mm. The focal length is equal to the total thickness of both materials. The line width is approximately 50% of the lenticle width but can be increased to enhance the security aspect, probable aberrations in the lens enabling the eye to see a wider zone behind each lenticle allowing the viewer still to read the document easily with indicia of any color when rotated to the best viewing angles.

It will be appreciated that the surface contour variations defining the lens faces are virtually invisible to the naked eye (although shown on the drawing for the purpose of illustration) while the printed information appears essentially continuous as a single unbroken image with very fine resolution and clarity providing a much better result than is provided by the dimensions of the first embodiment which allows for large variations in adhesive thickness.

In the embodiment shown in FIG. 5, a lenticular screen 11$^{III}$ similar to that described in relation to FIG. 4 forms only the front side of the envelope 20$^{1}$, the rear side 26 being of opaque plastic material.

The application of the protecting sheet-form screen does not require any special skill and may be performed quickly, simply and conveniently in the office, when required, without training and time consuming preparation.

In other embodiments, the individual ribs forming the lens segments may extend at any desired direction on the sheet-form screen, according to the required viewing direction.

Alternatively, the PVC sheet may be 0.25 mm thick so as to be substantially more flexible and of less weight and bulk. The lens portions or ribs may be of density of between 15–150 per cm according to the application and quality of detail to be protected. Generally, the higher the density, the greater will be the clarity with less distortion of the meaningful information.

The materials chosen may be selected from various known to be used in providing lenticular screen devices for parallax panoramagrams.

In some examples, the ribs constituting the lens portions need not be cylindrical while, for some applications the bands of light blocking striae need not be continuous but formed by broken lines.

The invention can be used with information in a range of colors or in black and white.

I claim:

1. A copy preventing sheet-form screen comprising a lenticular screen formed by a sheet of transparent material having front and rear faces and a series of adjacent lens portions with major optical axes perpendicular to the front face and a series of light blocking striae located spaced apart underlying respective lens portions and extending across a major part of their major optical axes so that positioning the copy preventing sheet-form screen with the rear face in covering relation to a sheet carrying indicia providing meaningful information, enables the information to be easily seen when viewed obliquely in ambient white light bu prevents a meaningful copy thereof being made by conventional, perpendicularly aligned, phototransference techniques including at least one of xerographic, offset printing, and facsimile.

2. A copy preventing sheet-form screen according to claim 1 in which the striae comprise dark bands.

3. A copy preventing sheet-form screen according to claim 1 in which the striae provide mirror surfaces.

4. A copy preventing sheet-form screen according to claim 1 in which the striae are applied to the rear face of the screen by one of printing and embossing processes.

5. A copy preventing sheet-form screen according to claim 1 including a layer of adhesive on the rear face and a backing sheet removably attached to the rear face, covering the adhesive.

6. A copy preventing sheet-form screen according to claim 1 in which the lens portions are formed by parallel ribs providing cylindrical segments.

7. A copy preventing sheet-form screen according to claim 6 in which the ribs are at a density of between 15 and 150 per cm.

8. A copy preventing sheet-form screen according to claim 7 in which the screen in made of PVC of 0.25 mm thickness.

9. A copy preventing sheet-form screen according to claim 8 in which the ribs forming the lens portions are at a density of 20 per cm and the striae are 0.25 mm in width.

10. A sheet of material carrying indicia providing meaningful information on a front face thereof covered by a copy preventing layer comprising a lenticular screen formed by a sheet of transparent material having front and rear faces and a series of adjacent lens portions with major optical axes perpendicular to the front face and a series of spaced apart, light blocking striae underlying perspective lens portions so as to extend across a major part of their major optical axes and alternating with striae of indicia providing the meaningful information so that the information is easily seen when the sheet is viewed obliquely in ambient white light but a meaningful copy thereof cannot be made by conventional, perpendicularly aligned, phototransference techniques including at least one of xerographic, offset printing, and facsimile.

11. A sheet of material according to claim 10 in which the striae provide mirror surfaces.

12. A method of preventing a meaningful copy of information provided by a sheet of indicia being made by conventional, perpendicularly aligned, phototransference techniques including at least one of xerographic, offset printing, and facsimile, comprising the steps of providing a lenticular screen covering the indicia formed by a sheet of transparent material having front and rear faces and a series of adjacent lens portions with major optical axes perpendicular to the front face and a series of light blocking striae, located spaced, apart underlying respective lens portions so as to extend across a major part of their optical axes so that the information is easily seen by viewing obliquely in ambient white light but a meaningful copy thereof cannot being made by conventional, perpendicularly aligned, phototransference techniques including at least one of xerographic, offset printing, and facsimile.

13. A method according to claim 12 in which the striae provide mirror surfaces

14. A copy preventing adhesive tape comprising a lenticular screen formed by a sheet of transparent material having front and rear faces and a series of adjacent lens portions with major optical axes perpendicular to the front face and a series of light blocking striae located spaced apart underlying respective lens portions and extending across a major part of their major optical axes so that positioning the copy preventing tape with the rear face in covering relation to a sheet carrying indicia providing meaningful information, enables the information to be easily seen when viewed obliquely in ambient white light but prevents a meaningful copy thereof being made by conventional, perpendicularly aligned, phototransference techniques including at least one of xerographic, offset printing, and facsimile.

15. A copy preventing sheet-form screen comprising an optical screen including an array of adjacent, alternately arranged, first and second optical portions having respective major reflecting optical axis extending obliquely of and perpendicularly to the sheet-form screen, respectively, and an array of adjacent, alternately arranged, first and second striae of indicia forming meaningful information to be protected and other matter not to be protected, respectively, optically aligned with the first and second optical portions respectively, so that the information is easily seen when viewed obliquely in ambient white light but a legible copy of the meaningful information cannot be made by conventional, perpendicularly aligned, phototransference techniques including at least one of xerographic, offset printing, and facsimile.

16. A copy preventing sheet-form screen comprising an optical screen including an array of adjacent, alternately arranged, first and second optical portions having respective major reflecting optical axes extending obliquely of and perpendicularly to the sheet-form screen, respectively, and an array of adjacent, alternately arranged, first and second transparent and light obstructing portions, respectively, optically aligned with the optical axes of the first and second optical portions respectively, so when the sheet-form screen is overlaid on a sheet covered by indicia forming meaningful information, the information is easily seen when viewed obliquely in ambient white light but a legible copy of the meaningful information cannot be made by conventional, perpendicularly aligned, phototransference techniques including at least one of xerographic, offset printing, and facsimile.

* * * * *